US005551265A

United States Patent [19]

Garman et al.

[11] Patent Number: 5,551,265

[45] Date of Patent: Sep. 3, 1996

[54] RESTRAINT MECHANISM FOR A CONTROL LEVER

[75] Inventors: Ronald H. Garman, Pekin; Stephen C. Garnett, Princeville; Steven L. Groth, Morton, all of Ill.

[73] Assignee: Caterpillar Inc., Peoria, Ill.

[21] Appl. No.: 431,698

[22] Filed: Apr. 28, 1995

[51] Int. Cl.[6] ..... G05G 5/28

[52] U.S. Cl. ..... 70/177; 70/159; 70/180; 70/203; 70/247; 74/526; 251/95; 251/114

[58] Field of Search ..... 70/198–203, 158–162, 70/164, 175–180, 237, 245–248, 254, 212; 74/526; 137/383; 251/95, 114

[56] References Cited

U.S. PATENT DOCUMENTS

| | | | |
|---|---|---|---|
| 1,386,543 | 8/1921 | Tiller | 70/199 |
| 1,444,379 | 2/1923 | Jones | 70/202 |
| 1,475,863 | 11/1923 | Pate | 70/199 |
| 1,596,083 | 8/1926 | Cyganczuk | 70/202 |
| 3,372,280 | 3/1968 | Auld et al. | 250/106 |
| 3,795,152 | 3/1974 | Campbell | 74/471 R |
| 3,810,369 | 5/1974 | Glovanniello | 70/202 |
| 4,036,077 | 7/1977 | Akiyama | 74/526 |
| 4,077,276 | 3/1978 | Knox, Jr. | 70/203 X |
| 4,269,081 | 5/1981 | Peterson et al. | 74/473 R |
| 4,282,769 | 8/1981 | Sandrock | 74/475 |
| 4,326,432 | 4/1982 | Miller | 74/475 |
| 4,421,287 | 12/1983 | Durno | 244/223 |
| 4,548,094 | 10/1985 | Huitema et al. | 74/526 |
| 4,704,915 | 11/1987 | Friesen et al. | 74/471 X |
| 4,708,005 | 11/1987 | Bernacchi | 70/238 |
| 4,747,279 | 5/1988 | Solow | 70/238 |
| 4,887,483 | 12/1989 | Vollath | 74/526 |
| 5,038,667 | 8/1991 | Slater | 70/199 |
| 5,325,733 | 7/1994 | Papasideris et al. | 74/483 R |

*Primary Examiner*—LLoyd A. Gall
*Attorney, Agent, or Firm*—William C. Perry

[57] ABSTRACT

The connecting linkage between a control lever and a control valve that controls the operation or the manipulation of an implement of a construction machine is often complex and difficult to properly adjust. The present invention provides a restraint mechanism for the control lever 10 to maintain its position in a neutral condition with respect to the control valve. A first plate 42 is pivotally mounted to a base plate 22 on the console of the machine and is movable to a first position to engage the control lever 10 and establish a neutral position. A second plate 58 is utilized to selectively secure the position of the first plate with respect to the control lever while the proper connections and adjustments are made to the linkage arrangements connecting the control lever 10 and the control valve to synchronize their respective neutral positions.

11 Claims, 4 Drawing Sheets

RESTRAINT MECHANISM FOR A CONTROL LEVER

TECHNICAL FIELD

This relates generally to control levers and more particularly to a mechanism used to restrain the control lever from movement.

BACKGROUND ART

In construction machines it is very common to have multiple levers at an operators disposal to control the movement of the machine as well as the implements that are attached to the machine. These levers are commonly positioned within an operator station mounted on the machine and are connected by various linkage arrangements to control valves that in turn control the various implements and machine functions. It is very important that these levers are adjusted properly with respect to the connecting linkage to insure efficient operation of the machine. In many instances, the adjustment of these linkages occurs at a location that is remote from that of the control levers. It is important therefore to have a positive mechanism to hold the control lever in a preselected position, usually the neutral position, so that proper adjustment may be made to the connecting linkage. In many instances one individual is required to maintain the position of the control lever in the neutral position while a second adjusts the connecting linkage. Aside from being inefficient in the use of personnel, it also lends itself to an inaccurate adjustment in the event two people are not available when it is necessary to make the proper adjustments.

The present invention is directed to overcoming one or more of the problems as set forth above.

DISCLOSURE OF THE INVENTION

In one aspect of the present invention, a restraint mechanism is provided for a control lever. The restraint mechanism includes a first plate that has a first end portion that defines a receiving portion that has a preselected configuration. A first aperture is also formed through the first plate. A second end portion of the first plate is pivotally mounted to a base plate that is located adjacent the control lever. The control lever is moveable between a first position wherein the receiving portion is positioned to encapsulate a portion of the control lever to restrain the movement of the control lever and a second position wherein the first plate is pivoted away from engagement with the control lever. A support member is provided that has a first end portion mounted to the base member and a second end portion that has an aperture formed therethrough. The second end portion is adapted for receipt within the first aperture of the first plate when the first plate is in its first position. A second plate has an engagement portion defined on a first end portion and an aperture defined on a second end portion. The second plate is pivotally mounted to the first plate for movement between first and second positions. In the first position, the engagement portion of the second plate is received within the aperture defined by the support member to maintain the first plate in its first position. In the second position the engagement portion is pivoted away from the aperture defined by the support member thereby allowing the first plate to be moved to its second position.

BEST MODE FOR CARRYING OUT THE INVENTION

Figure 1:
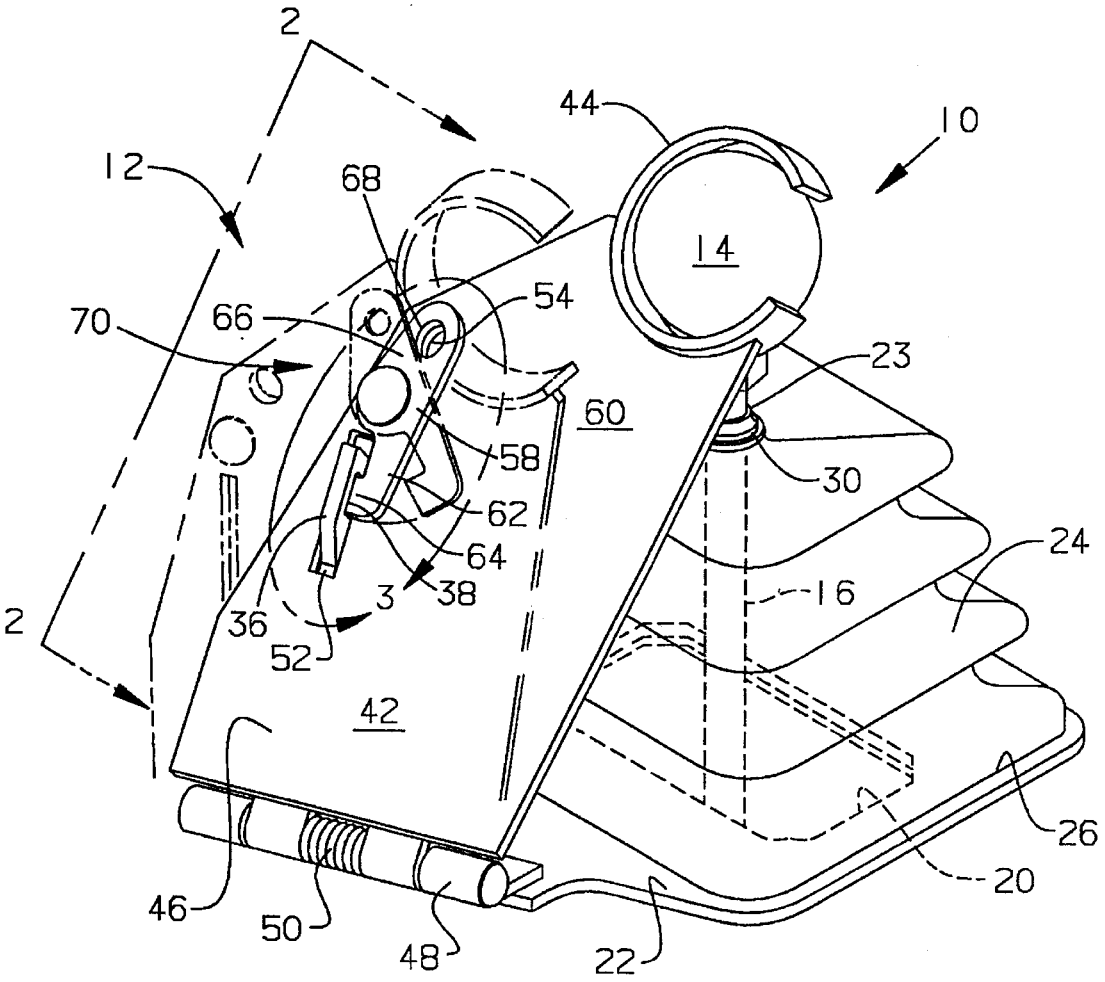
FIG. 1 is a diagrammatic perspective view of a restraint mechanism for a control lever that embodies the principles of the present invention.

Referring to the drawings, a restraint mechanism for a control lever 10 is shown generally at 12. The control lever 10 includes a grasping portion 14 which, in the illustrated embodiment, is shown to be spherical in configuration. The grasping portion is configured to be a sufficient size and shape to fit easily within the hand of an operator to permit easy manipulation of the control lever. While it is shown to be spherically shaped, it is to be understood that another shape may be used without departing from the intent of the present invention. A rod portion 16 extends from the grasping portion 14, through an opening 20 in a base plate 22 and is connected to a linkage arrangement (not shown) that extends between the control lever and a control valve. The control valve may typically be a hydraulic control valve that selectively directs pressurized fluid to various hydraulic actuators to control a machine function or a work implement. The rod portion 16 has a first, threaded end portion 23 that engages the grasping portion to secure the grasping portion to the rod portion 16. A boot 24, made of rubber or other flexible material, is mounted at its base 26 to the base plate 22 and extends upward therefrom to define an aperture 30 that receives the rod portion at a point just below the grasping portion. Since the boot material is flexible, it moves with the control lever and serves to prevent the ingress of dirt and noise into the operator station.

A support member 32 has a first end portion 34 that is mounted to the base plate 22. The support member extends upward from the base plate and terminates at a second end portion 36 that defines an elongate slot 38. An abutment portion 40 is defined on the second end portion of the support member at a location adjacent the slot 38. The slot and the abutment portion 40 are situated at an angle with respect to the base plate 22.

A first plate 42 has a first end portion 44 that defines a preselected configuration that closely matches the configuration of the grasping portion 14 of the control lever 10. In the instant embodiment, the first end portion 44 is C-shaped and has an internal diameter that is slightly larger that the diameter of the spherical grasping portion 14 of the control lever 10. The shape of the first end portion of the first plate is consistent with that of the grasping portion of the control lever so that the control lever may be encapsulated therewithin. A second end portion 46 of the first plate is attached to the base plate 22 at a location that is adjacent the control lever 10. The second end portion 46 is secured to the base plate by a hinge member 48. The hinge member includes a torsion spring 50 (FIG. 3) that biases the first plate outwardly, or to the right as viewed in FIG. 2, in the position shown in phantom lines. A first aperture 52, in the shape of an elongate slot, is formed in the first plate at a location intermediate the end portions thereof along with a second aperture or bore 54. The first plate may be positioned in a first position wherein a first side 56 is placed in contact with the abutment portion 40 of the support member 32. The first aperture 52 is located on the first plate 42 at a preselected position so that it will register with the second end portion 36 of the support member. The second end portion is therefore received within the first aperture 52 when the first plate is in its first position.

Figure 3:
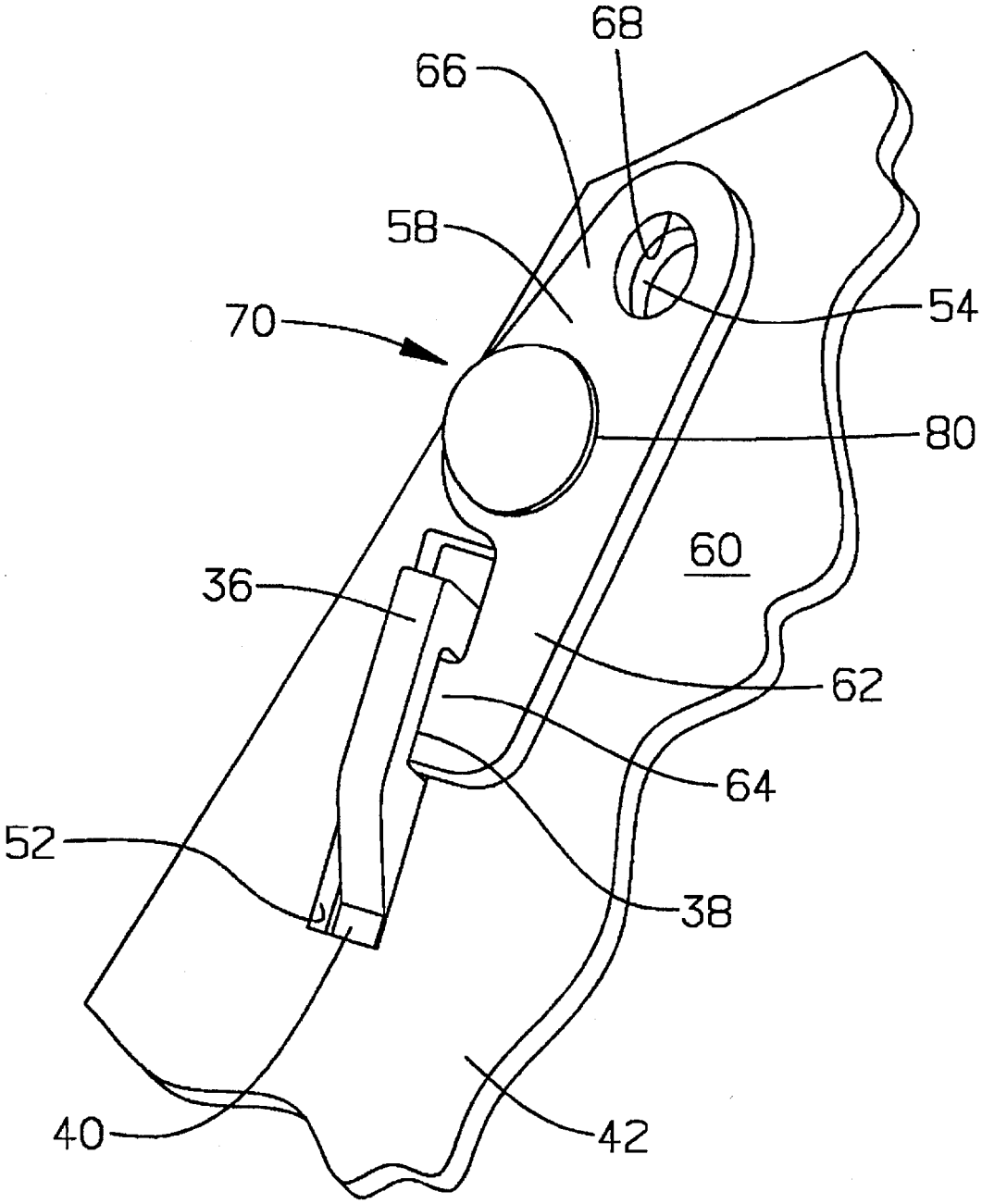
FIG. 3 is an enlarged view of the area indicated at 3 in FIG. 1.
Figure 4:
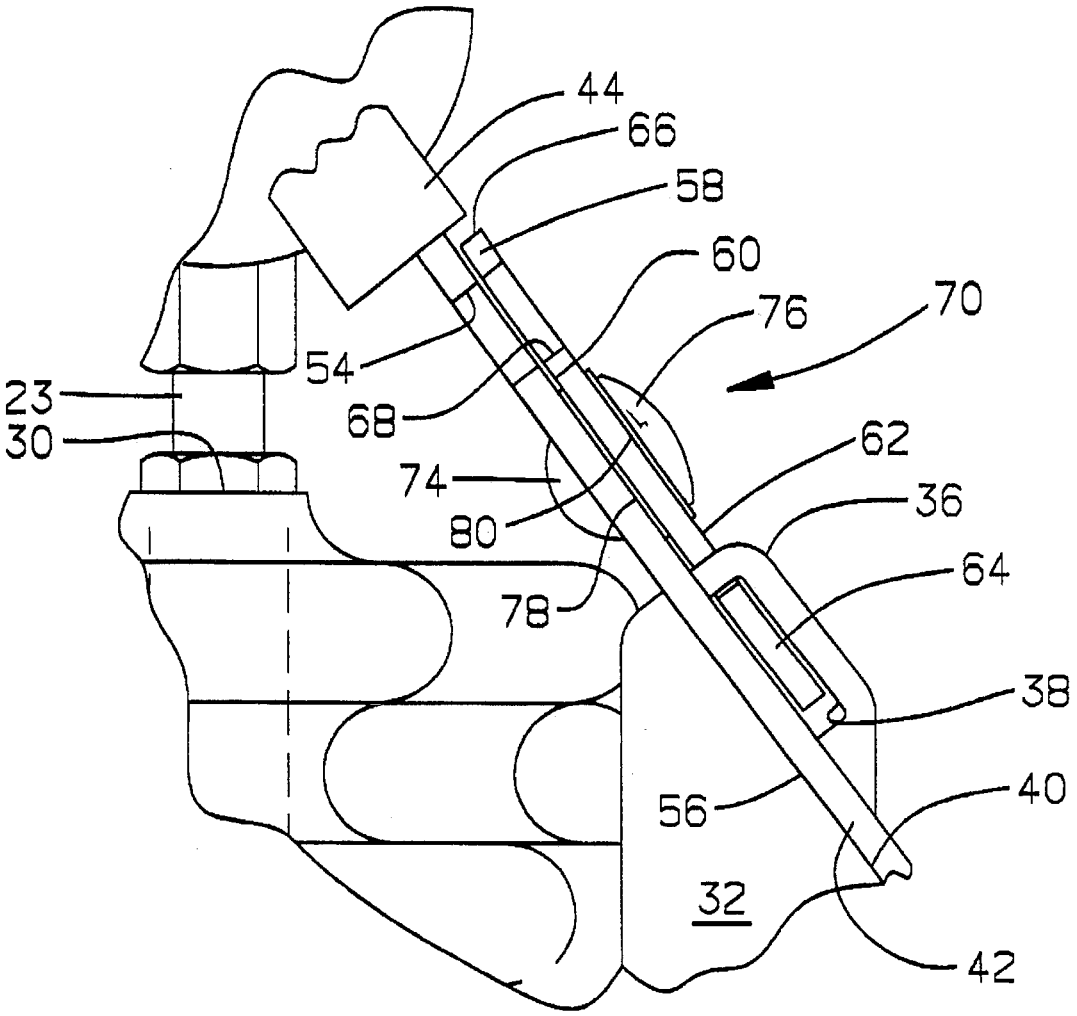
FIG. 4 is an enlarged view of the area indicated at 4 in FIG. 2.

A second plate 58 is pivotally mounted to a second side 60 of the first plate 42. The second plate has a first end portion 62 that defines an engagement portion, or tang 64, which is best shown in FIG. 3. A second end portion 66 is defined by the second plate and has an aperture or bore 68 extending therethrough. The second plate 58 is pivotally mounted to the first plate 42 by a rivet assembly 70. The rivet assembly defines a rivet that has a first head portion 74 that is positioned to bear against the first side 56 of the first plate 42. A second head portion 76 is positioned on the second side of the first plate 42. The second plate 58 is positioned between the first plate 42 and the second head portion and is sandwiched therebetween by a pair of spring washers 78 and 80. The rivet assembly 70 has enough clearance between the first and second head portions to allow the second plate 58 to be rotated with respect to the first plate 42, however, since the spring washers are mounted in a compressed condition, there is enough friction in the rivet assembly to prevent unwarranted movement due to vibration or the like.

INDUSTRIAL APPLICABILITY

Figure 2:
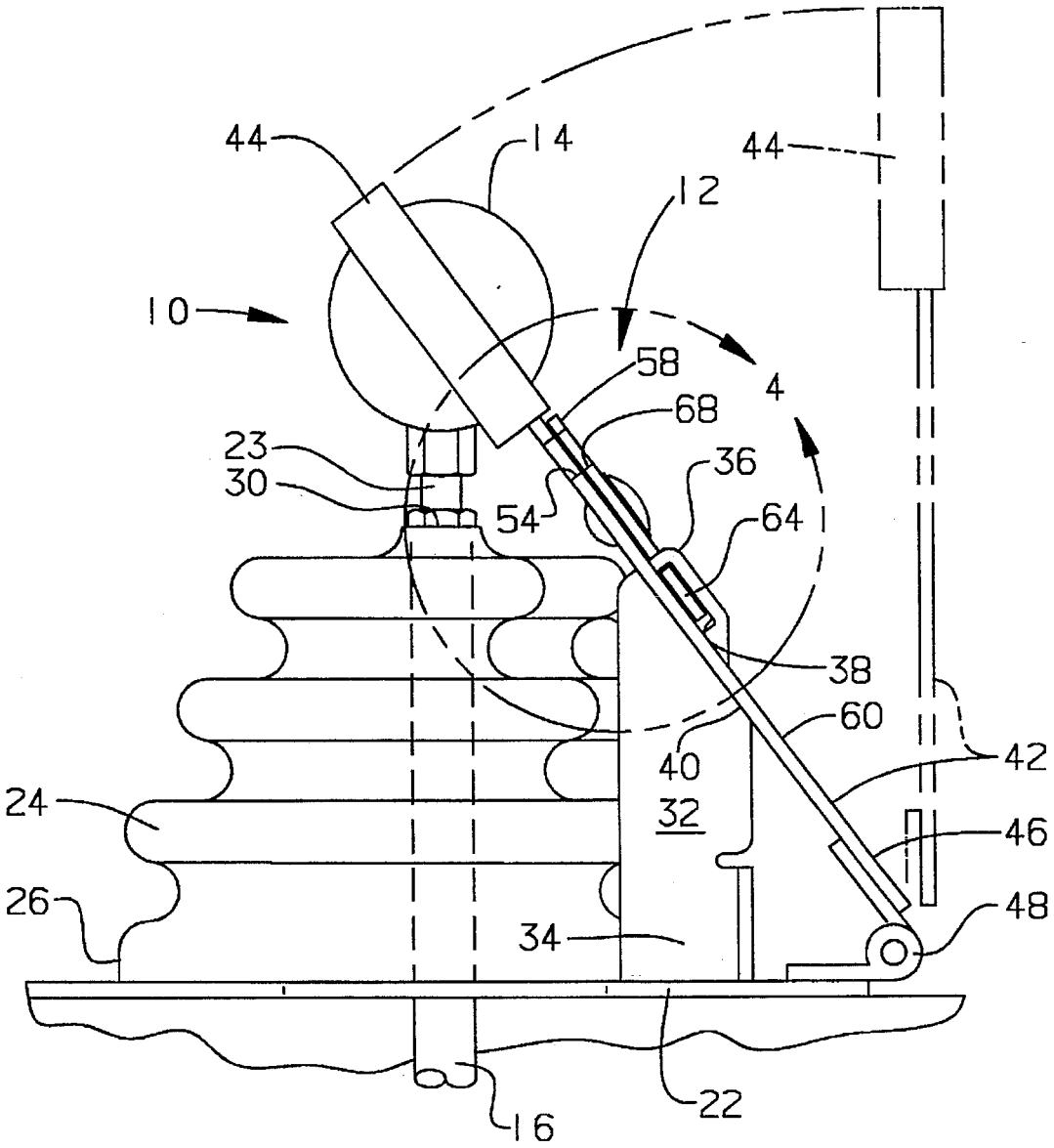
FIG. 2 is a diagrammatic end view of the control lever as viewed along lines 2—2 of FIG. 1.

When in use, the first plate 42 is rotated inwardly, as viewed in FIG. 2, until it comes in contact with the abutment portion 40 of the support member 32. This establishes the first position of the first plate 42. In this position, the second end portion 36 of the support member 32 is received within the first aperture 52 of the first plate. Also in this position, the first plate will be oriented at a preselected angle with respect to the base plate 22. The angle of the base plate and the angle of the slot 38 of the support member are substantially the same. Being so configured, the slot 38 is positioned adjacent the second side 60 of the first plate 42 and is positioned in substantially parallel relationship thereto.

When the first plate 42 is in the first position, the C-shaped first end portion 44 is placed at a location that is substantially adjacent the grasping portion 14 of the control lever 10. The control lever may be maneuvered slightly to position the grasping portion within the C-shaped portion of the first plate 42. Since the grasping portion 14 is threadably engaged with the rod portion 16, the grasping portion may be threaded up or down the rod to moderately adjust the position of the grasping portion so that it will nest within the C-shaped receptacle. The C-shaped portion 44 is configured to extend around a minimum of approximately 200 degrees of the spherical portion to encapsulate the spherical portion and restrain it from motion in any direction. While it is envisioned that shapes other than a sphere may also work, it is important to realize that the first end portion 44 of the first plate 42 must have a shape complementary to that of the grasping portion. Further, it must encapsulate enough of the grasping portion to restrain it from movement in any direction. For this purpose, a spherical shape is preferable as it lends itself to simplicity of the design.

After the first plate 42 is in its first position and the grasping portion 14 is encapsulated, the second plate 58 may be rotated to its first position to maintain the position of the first plate. In its first portion, the first end portion 62 of the second plate 58 is rotated to position the engagement portion, or tang 64, within the slot 38 of the support member 32. This will prevent the movement of the first plate to its second position unless the tang 64 is purposely rotated away from engagement with the slot 38. Further, when the second plate 58 is in this position, the aperture 68 defined in the second end portion 66 is aligned with the second aperture 54 defined in the first plate 42. This alignment permits the placement of a shackle of a padlock or similar device within the aligned apertures to positively prevent the second plate from being moved to its second, disengaged position.

With a restraint mechanism as set forth above, the control lever of any or all of the various machine functions or implements may be restrained in a neutral position while the linkage arrangement between the control lever and the control valve is properly connected and adjusted. This restraint mechanism allows this to be accomplished in an extremely efficient and cost effective manner with a minimum of personnel.

Other aspects, objects and advantages of this invention can be obtained from a study of the drawings, the disclosure and the appended claims.

We claim:

1. A restraint mechanism for a control lever, comprising:

a first plate having a first end portion and a first aperture formed therethrough, said first end portion defining a receiving portion having a preselected configuration, said first plate being pivotally mounted to a base plate at a second end portion thereof for being located adjacent the control lever and being moveable between a first position wherein the receiving portion is positioned to encapsulate a portion of the control lever to restrain the movement of the control lever and a second position wherein the first plate is pivoted away from engagement with the control lever;

a support member having a first end portion mounted to the base plate and a second end portion having an aperture formed therethrough, said second end portion being adapted for receipt within the first aperture of the first plate when the first plate is in its first position; and a second plate having a first end portion having an engagement portion defined thereon and a second end portion having an aperture extending therethrough, said second plate being pivotally mounted at a point spaced from said aperture of said second plate to the first plate for movement between a first position wherein the engagement portion of the second plate is received within the aperture defined by the support member when the first plate is in its first position and a second position wherein the engagement portion is pivoted away from engagement with the aperture defined by the support member.

2. The restraint mechanism as set forth in claim 1 wherein the control lever defines a grasping portion that is substantially spherical in configuration.

3. The restraint mechanism as set forth in claim 2 wherein the receiving portion is C-shaped in configuration and has an inner dimension that is slightly larger than the diameter of the spherical grasping portion so that the C-shaped portion will surround at least 200 degrees of said spherical portion when the first plate is in its first position.

4. The restraint mechanism as set forth in claim 2 wherein the control lever further includes a rod portion, said grasping portion being threadably engaged with the rod portion to adjust the height of the grasping portion with respect to the first end portion of the first plate to permit the grasping portion to be positioned within the receiving portion of the first plate.

5. The restraint mechanism as set forth in claim 1 wherein the first plate is mounted to the base plate by a hinge member having a torsion spring mounted therein, said torsion spring having a biasing force that reacts against the first plate to urge it toward its second position.

6. The restraint mechanism as set forth in claim 1 wherein the support member includes a generally vertically oriented plate that has an abutment portion defined on the second end portion thereof, said abutment portion adapted to engage a first side of the first plate when the first plate is in its first position.

7. The restraint mechanism as set forth in claim 6 wherein the aperture defined by the second end portion of the support member is an elongated slot, said slot being positioned on a second side of the first plate when the first plate is in its first position.

8. The restraint mechanism as set forth in claim 7 wherein the first aperture defined by the first plate is a slot that is of sufficient size to receive the second end portion of the support member.

9. The restraint mechanism as set forth in claim 8 wherein the first plate further defines a second aperture that extends therethrough.

10. The restraint mechanism as set forth in claim 9 wherein the second plate is pivotally mounted on the second side of the first plate and the aperture defined in the second end portion thereof is positioned in registry with the second aperture of the first plate when the first and second plates are in their respective first positions.

11. The restrain mechanism as set forth in claim 10 wherein the second plate is pivotally mounted to the first plate by a rivet assembly including:

a first and second head portion defined by the rivet, said first head portion being adapted to bear against the first side of the first plate and said second head portion being positioned on the second side of the first plate;

first and second spring washers positioned on opposite sides of the second plate.

* * * * *